US010941720B2

(12) United States Patent
Tachibana et al.

(10) Patent No.: US 10,941,720 B2
(45) Date of Patent: Mar. 9, 2021

(54) CONTROL DEVICE FOR INTERNAL-COMBUSTION ENGINE

(71) Applicant: TOYOTA JIDOSHA KABUSHIKI KAISHA, Toyota (JP)

(72) Inventors: Rintarou Tachibana, Toyota (JP); Hirokatsu Yamamoto, Obu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 16/573,000

(22) Filed: Sep. 17, 2019

(65) Prior Publication Data

US 2020/0149486 A1 May 14, 2020

(30) Foreign Application Priority Data

Nov. 8, 2018 (JP) ..... 2018-210253

(51) Int. Cl.

| | |
|---|---|
| ***F02D 41/00*** | (2006.01) |
| ***F02B 37/16*** | (2006.01) |
| ***F02M 35/10*** | (2006.01) |
| *F02M 25/08* | (2006.01) |

(52) U.S. Cl.

CPC ..... *F02D 41/0045* (2013.01); *F02B 37/168* (2013.01); *F02D 41/004* (2013.01); *F02M 35/1038* (2013.01); *F02M 25/0836* (2013.01)

(58) Field of Classification Search

CPC .... F02D 41/00; F02D 41/004; F02D 41/0045; F02B 37/16; F02B 37/168; F02M 35/06; F02M 35/0836; F02M 35/10; F02M 35/1038

USPC ..... 123/518–520

See application file for complete search history.

(56) References Cited

U.S. PATENT DOCUMENTS

| | | | | |
|---|---|---|---|---|
| 6,155,796 | A * | 12/2000 | Schmalz | F04F 5/20 417/182 |
| 2014/0196694 | A1* | 7/2014 | Euliss | F02M 25/0872 123/520 |
| 2014/0257672 | A1* | 9/2014 | Surnilla | F02M 25/0836 701/103 |

(Continued)

FOREIGN PATENT DOCUMENTS

| | | |
|---|---|---|
| JP | 7-019057 | 1/1995 |
| JP | 2017-031936 | 2/2017 |
| JP | 2018-096247 | 6/2018 |

*Primary Examiner* — John Kwon
*Assistant Examiner* — Johnny H Hoang
(74) *Attorney, Agent, or Firm* — Finnegan, Henderson, Farabow, Garrett & Dunner, LLP

(57) ABSTRACT

A control device for an internal-combustion engine, includes: an ejector including an exhaust port coupled to an intake passage upstream of a compressor, an intake port coupled to a recirculation passage recirculating intake air from the intake passage downstream of the compressor to the intake passage upstream of the compressor, and a suction port coupled to a first branch passage; a first pressure acquirer obtaining a first pressure that is a pressure upstream of the compressor in the intake passage; a second pressure acquirer obtaining a second pressure that is a pressure downstream of the compressor in the intake passage; and an ejector negative pressure estimator configured to estimate an ejector negative pressure based on an opening period of the purge valve and the second pressure.

7 Claims, 10 Drawing Sheets

(56) References Cited

U.S. PATENT DOCUMENTS

| | | | | |
|---|---|---|---|---|
| 2016/0201613 | A1* | 7/2016 | Ulrey | F02D 41/0007 123/520 |
| 2017/0226939 | A1* | 8/2017 | Akita | B01D 53/0415 |
| 2017/0276078 | A1* | 9/2017 | Imaizumi | F02D 41/0007 |
| 2018/0163646 | A1* | 6/2018 | Tsutsumi | F02M 25/0854 |
| 2019/0048830 | A1* | 2/2019 | Akiyama | F04F 5/46 |

* cited by examiner

FIG. 7

| SUPERCHARGING PRESSURE / VSV DRIVE DUTY | Ps1 | Ps2 | Ps3 | Ps4 | ..... |
|---|---|---|---|---|---|
| D1 | Pe11 | Pe21 | Pe31 | Pe41 | ..... |
| D2 | Pe12 | ⋱ | | | |
| D3 | Pe13 | | | | |
| D4 | Pe14 | | | | |
| D5 | Pe15 | | | | |
| ⋮ | ⋮ | | | | |

MAP FOR EJECTOR NEGATIVE PRESSURE ESTIMATION

MAP FOR ESTIMATING PURGE FLOW RATE FROM EJECTOR NEGATIVE PRESSURE IN SUPERCHARGING RANGE

MAP FOR ESTIMATING PURGE FLOW RATE FROM INTAKE PRESSURE IN NA RANGE

CONTROL DEVICE FOR INTERNAL-COMBUSTION ENGINE

CROSS-REFERENCE TO RELATED APPLICATION

This application is based upon and claims the benefit of priority of the prior Japanese Patent Application No. 2018-210253, filed on Nov. 8, 2018, the entire contents of which are incorporated herein by reference.

TECHNICAL FIELD

The present disclosure relates to a control device for an internal-combustion engine.

BACKGROUND

Fuel vapor generated in a fuel tank is supplied as purge gas to an intake system, and then is burned as disclosed in, for example, Japanese Patent Application Publication No. 2017-31936 (hereinafter, referred to as Patent Document 1). The control device disclosed in Patent Document 1 includes a first branch passage that delivers the purge gas passing through a purge valve to the area upstream of a supercharge through an ejector, and a second branch passage that delivers the purge gas passing through the purge valve to the area downstream of the supercharger. In Patent Document 1, the purge flow rate, which is the amount of the purge gas to be delivered to the intake system through the branch passages, is calculated based on a first pressure, which is a pressure at the downstream end of the first branch passage, and a second pressure, which is a pressure at the downstream end of the second branch passage.

SUMMARY

It is therefore an object of the present disclosure to provide a control device for an internal-combustion engine that estimates a pressure, which may affect the flow rate of the purge gas to be delivered to an intake passage through an ejector, with high accuracy.

The above object is achieved by a control device for an internal-combustion engine, including: a canister recovering fuel evaporated in a fuel tank; a purge valve configured to control a flow rate of purge gas flowing out from the canister; a turbocharger including a compressor disposed in an intake passage; a purge passage connecting the canister and the intake passage and branching into a first branch passage and a second branch passage, the first branch passage being coupled to the intake passage upstream of the compressor, the second branch passage being coupled to the intake passage downstream of the compressor; an ejector including an exhaust port, an intake port, and a suction port, the exhaust port being coupled to the intake passage upstream of the compressor, a recirculation passage being coupled to the intake port, the recirculation passage recirculating intake air from the intake passage downstream of the compressor to the intake passage upstream of the compressor, the first branch passage being coupled to the suction port; a first pressure acquirer configured to obtain a first pressure that is a pressure upstream of the compressor in the intake passage; a second pressure acquirer configured to obtain a second pressure that is a pressure downstream of the compressor in the intake passage; and an ejector negative pressure estimator configured to, when the second pressure is higher than the first pressure and the intake passage downstream of the compressor is supercharged, estimate an ejector negative pressure based on an opening period of the purge valve and the second pressure, the ejector negative pressure being a pressure at which the ejector delivers, through the suction port, the purge gas to the intake passage upstream of the compressor.

In the above configuration, the ejector negative pressure estimator is configured to estimate a value of the ejector negative pressure to be smaller as the opening period of the purge valve is longer, and is configured to estimate a value of the ejector negative pressure to be smaller as the second pressure is smaller.

In the above configuration, each of the first branch passage and the second branch passage may include a check valve that inhibits flowback of the intake air from the intake passage, and the control device may further include a retention negative pressure calculator configured to calculate a retention negative pressure based on the ejector negative pressure and the first pressure, the retention negative pressure being a negative pressure between the check valves and the purge valve when the purge valve is in a closed state.

In some embodiments, the purge valve may be a duty control valve of which an opening period is controlled according to a drive duty.

The control device for an internal-combustion engine may further include a purge flow rate estimator configured to, when the intake passage downstream of the compressor is supercharged, estimate a flow rate of purge gas to be delivered to the intake passage through the first branch passage based on the ejector negative pressure.

In some embodiments, the opening period of the purge valve may be set according to a flow rate of the purge gas requested to be delivered to the intake passage and the retention negative pressure. In some embodiments, the opening period of the purge valve may be set by correcting a time corresponding to a flow rate of the purge gas requested to be delivered to the intake passage according to the retention negative pressure.

In some embodiments, the control device for an internal-combustion engine may further include a purge flow rate estimator configured to calculate a first flow rate of purge gas to be delivered to the intake passage through the first branch passage and a second flow rate of purge gas to be delivered to the intake passage through the second branch passage to calculate a total flow rate of purge gas to be delivered to the intake passage based on the first flow rate calculated and the second flow rate calculated.

BRIEF DESCRIPTION OF THE DRAWINGS

FIG. 7 illustrates a map for ejector negative pressure estimation;

DETAILED DESCRIPTION

Figure 1:
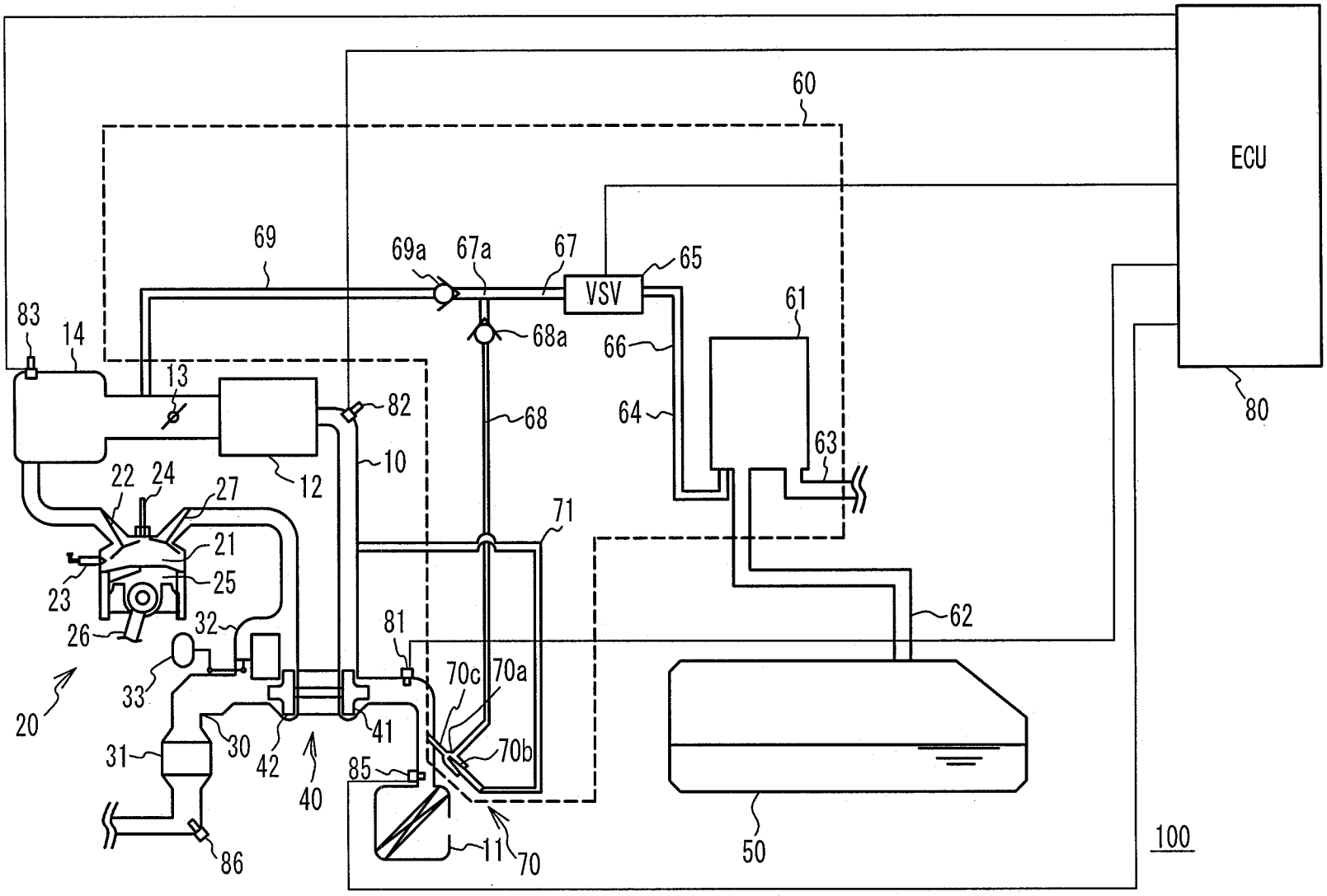
FIG. 1 illustrates a structure of an internal-combustion engine system including a control device for an internal-combustion engine in accordance with an embodiment.

The purge flow rate affects the control of the air-fuel ratio (A/F). Thus, it is desired to estimate the flow rate of the purge gas actually delivered to the intake system with the highest possible accuracy, and reflects the estimated purge flow rate to the subsequent control. However, when the mechanism that delivers the purge gas through the ejector and the delivery path of the purge gas are considered, to estimate the purge flow rate with high accuracy, Patent Document 1 has room for further improvement.

Hereinafter, an embodiment of the present disclosure will be described with reference to the accompanying drawings. In the drawings, the dimensions, proportions, and so on of each component are not necessarily illustrated so as to completely correspond to actual ones. In some drawings, illustration of details are omitted.

Embodiment

With reference to FIG. 1, the following describes an internal-combustion engine system 100 including a control device for an internal-combustion engine in accordance with an embodiment. The internal-combustion engine system 100 is installed in vehicles such as automobiles. The internal-combustion engine system 100 includes an intake passage 10 and an internal-combustion engine 20 in which intake air delivered from the intake passage 10 and fuel injected from a fuel injection valve 23 are mixed and then burned. The internal-combustion engine system 100 also includes an exhaust passage 30, a turbocharger 40, and a purge system 60. The exhaust passage 30 discharges the exhaust gas of the internal-combustion engine 20. The turbocharger 40 supercharges intake air with the exhaust gas passing through the exhaust passage 30. The purge system 60 delivers the fuel evaporated in a fuel tank 50 to the intake passage 10. The internal-combustion engine system 100 further includes an electronic control unit (ECU) 80.

An air cleaner 11, a compressor 41 of the turbocharger 40, an intercooler 12, a throttle valve 13, and a surge tank 14 are disposed in the intake passage 10 in this order from the upstream side. The air cleaner 11 purifies the intake air drawn from the outside. The compressor 41 supercharges the intake air, and sends the supercharged intake air toward the internal-combustion engine 20. The intercooler 12 cools the intake air. The throttle valve 13 adjusts the air intake quantity. The surge tank 14 temporarily stores the intake air to be supplied to the internal-combustion engine 20.

The internal-combustion engine 20 includes a combustion chamber 21, an intake valve 22, the fuel injection valve 23, a spark plug 24, a piston 25, a connecting rod 26, an unillustrated crankshaft, and an exhaust valve 27. When the intake valve 22 opens, the intake air delivered from the intake passage 10 is sucked into the combustion chamber 21. The fuel injection valve 23 injects fuel into the combustion chamber 21. The spark plug 24 ignites an air-fuel mixture of the injected fuel and the intake air to burn the air-fuel mixture. A first end of the connecting rod 26 is connected to the piston 25. The piston 25 reciprocates to rotate the crankshaft connected to a second end of the connecting rod 26. The exhaust valve 27 discharges, to the exhaust passage 30, the exhaust gas after the air-fuel mixture burns in the combustion chamber 21.

A turbine 42 of the turbocharger 40 and a catalyst 31 are disposed in the exhaust passage 30 in this order from the upstream side. The turbine 42 rotates the compressor 41 with the energy of the exhaust gas. The catalyst 31 is, for example, a ternary catalyst, and purifies the exhaust gas. The exhaust passage 30 includes a turbine bypass passage 32 that allows the exhaust gas to bypass the turbine 42. The turbine bypass passage 32 includes a wastegate valve 33. The wastegate valve 33 controls the flow rate of the exhaust gas passing through the turbine bypass passage 32. The wastegate valve 33 is controlled by the ECU 80 such that the turbocharger 40 operates when the rotation speed of the internal-combustion engine 20 exceeds a predetermined rotation speed (e.g., 2000 rpm).

The purge system 60 includes a canister 61 that contains activated carbon, which adsorbs fuel vapor and can desorb the adsorbed fuel vapor, and adsorbs and stores the fuel evaporated in the fuel tank 50. The canister 61 is coupled to the fuel tank 50 through a fuel vapor passage 62. An atmosphere open passage 63 and a purge passage 64 are coupled to the canister 61.

The purge passage 64 includes a vacuum switching valve (VSV) 65 as a purge valve. The drive duty of the VSV 65 is controlled by the ECU 80. The VSV 65 is an example of a duty control valve of which the opening period is controlled according to the drive duty. The purge passage 64 includes an upstream passage 66 located upstream of the VSV 65 and a downstream passage 67 located downstream of the VSV 65.

The downstream passage 67 branches into a first branch passage 68 and a second branch passage 69 at a branching point 67*a*. The first branch passage 68 is coupled to the intake passage 10 upstream of the compressor 41. The downstream end of the first branch passage 68 is coupled to the intake passage 10 through an ejector 70.

The second branch passage 69 is coupled to the intake passage 10 downstream of the compressor 41. The downstream end of the second branch passage 69 is coupled to the intake passage 10 between the throttle valve 13 and the surge tank 14.

The ejector 70 includes a suction port 70*a*, an intake port 70*b*, and an exhaust port 70*c*. The first branch passage 68 is coupled to the suction port 70*a*. A recirculation passage 71 is coupled to the intake port 70*b*. The recirculation passage 71 recirculates the intake air from the intake passage 10 downstream of the compressor 41 to the intake passage 10 upstream of the compressor 41. The exhaust port 70*c* is coupled to the intake passage 10 upstream of the compressor 41. The intake port 70*b* has a tapered end. Thus, the intake air recirculated through the intake port 70*b* is reduced in pressure in the tapered end of the intake port 70*b*, and generates a negative pressure around the tapered end of the intake port 70*b*. This negative pressure causes purge gas to be drawn from the first branch passage 68 into the suction port 70*a*. The drawn purge gas is introduced, together with the intake air recirculated from the intake port 70*b*, into the intake passage 10 upstream of the compressor 41 through the exhaust port 70*c*.

A first check valve 68*a* is disposed in the upstream end part of the first branch passage 68. The first check valve 68*a* prevents flowback of the intake air from the intake passage 10. A second check valve 69*a* is disposed in the upstream end part of the second branch passage 69. The second check valve 69*a* prevents flowback of the intake air from the intake passage 10. A retention negative pressure may be generated in the region surrounded by the VSV 65, the first check valve 68*a*, and the second check valve 69*a*.

The retention negative pressure is a negative pressure that remains, when the VSV 65 becomes in a closed state, in the region surrounded by the VSV 65, the first check valve 68*a*, and the second check valve 69*a* and is retained. For example, while the VSV 65 is driven, the area downstream of the VSV 65 is communicated with the canister 61 being in an atmospheric pressure state, and is thus substantially in the atmospheric pressure state. When the VSV 65 stops, and becomes in a closed state, the pressure in the area downstream of the VSV 65 comes close to the negative pressure in the first branch passage 68 and the second branch passage 69, and the negative pressure becomes the retention negative pressure. For example, the pressure downstream of the VSV 65 approaches the pressure in the surge tank 14, which is a negative pressure, in a natural aspiration range (hereinafter, referred to as an "NA range"). Then, when the pressure upstream of the second check valve 69*a* and the pressure downstream of the second check valve 69*a* become negative pressures substantially equal to each other, the second check valve 69*a* closes. Accordingly, the negative pressure is retained in the region surrounded by the VSV 65, the first check valve 68*a*, and the second check valve 69*a*. The pressure downstream of the VSV 65 is substantially equal to the ejector negative pressure in a supercharging range. In the supercharging range, the inside of the intake passage 10 is supercharged, and the second check valve 69*a* is in a closed state. On the other hand, since the pressure upstream of the first check valve 68*a* and the pressure downstream of the first check valve 68*a* become negative pressures substantially equal to each other, the first check valve 68*a* closes. Accordingly, the negative pressure is retained in the region surrounded by the VSV 65, the first check valve 68*a*, and the second check valve 69*a*.

While the turbocharger 40 supercharges the intake air, i.e., while the internal-combustion engine system 100 is in the supercharging range, the purge gas mainly passes through the first branch passage 68, and is introduced into the intake passage 10 through the ejector 70. This is because in the supercharging range, the region of the intake passage 10 downstream of the compressor 41 is supercharged, and has a positive pressure. When the region of the intake passage 10 downstream of the compressor 41 has a positive pressure, the purge gas is not able to pass through the second branch passage 69.

On the other hand, in the supercharging range, the pressure downstream of the compressor 41 in the intake passage 10 is higher than the pressure upstream of the compressor 41 in the intake passage 10. Thus, a part of the supercharged intake air flows into the intake port 70*b* of the ejector 70 through the recirculation passage 71, and the intake air is recirculated. As a result, the purge gas is drawn into the suction port 70*a* of the ejector 70 from the first branch passage 68, and the purge gas is introduced into the intake passage 10 through the exhaust port 70*c*. Since the second check valve 69*a* is disposed in the second branch passage 69, the intake air in the intake passage 10 never flows back through the second branch passage 69.

While the turbocharger 40 does not supercharge the intake air, i.e., while the internal-combustion engine system 100 is in the NA range, the purge gas is introduced into the intake passage 10 mainly through the second branch passage 69. This is because, in the NA range, the pressure upstream of the compressor 41 in the intake passage 10 is higher than the pressure downstream of the compressor 41 in the intake passage 10. When the pressure upstream of the compressor 41 is higher than the pressure downstream of the compressor 41, the recirculation of the intake air through the ejector 70 does not occur. Thus, the pressure in the downstream end of the first branch passage 68 becomes equal to a pressure in a part of the intake passage 10 to which the ejector 70 is connected. This pressure is substantially equal to the atmospheric pressure. The canister 61 is open to the atmospheric pressure, and there is little difference in pressure between the upstream end and the downstream end of the first branch passage 68. Thus, the purge gas is less likely to be drawn into the first branch passage 68.

In addition, in the NA range, the intake passage 10 downstream of the compressor 41 has a negative pressure because of the movement of the piston 25, and thus the purge gas is introduced into the intake passage 10 through the second branch passage 69 by this negative pressure.

The internal-combustion engine system 100 includes first through third pressure sensors 81 through 83 disposed in the intake passage 10. The first pressure sensor 81 is disposed upstream of the compressor 41, and obtains the atmospheric pressure. The first pressure sensor 81 is an example of a first pressure acquirer configured to obtain a first pressure that is a pressure upstream of the compressor 41 in the intake passage 10. The second pressure sensor 82 is disposed between the compressor 41 and the intercooler 12, and obtains a supercharging pressure. The second pressure sensor 82 is an example of a second pressure acquirer configured to obtain a second pressure that is a pressure downstream of the compressor 41 in the intake passage 10. The third pressure sensor 83 is disposed in the surge tank 14, and obtains an intake pressure.

The internal-combustion engine system 100 further includes various sensors such as, but not limited to, an air flow meter 85 and an A/F sensor 86. The air flow meter 85 is disposed near the air cleaner 11 and measures the air intake quantity. The A/F sensor 86 is disposed in the exhaust passage 30, and measures an air-fuel ratio.

The ECU 80 includes a central processing unit (CPU) and a memory such as, but not limited to, a read only memory (ROM) and a random access memory (RAM). The ECU 80 controls the internal-combustion engine system 100 according to a program preliminarily stored in the memory. In addition, the ECU 80 outputs signals to the throttle valve 13 and the fuel injection valve 23, and outputs signals to the VSV 65 included in the purge system 60 to control the duty of the VSV 65.

Figure 2:
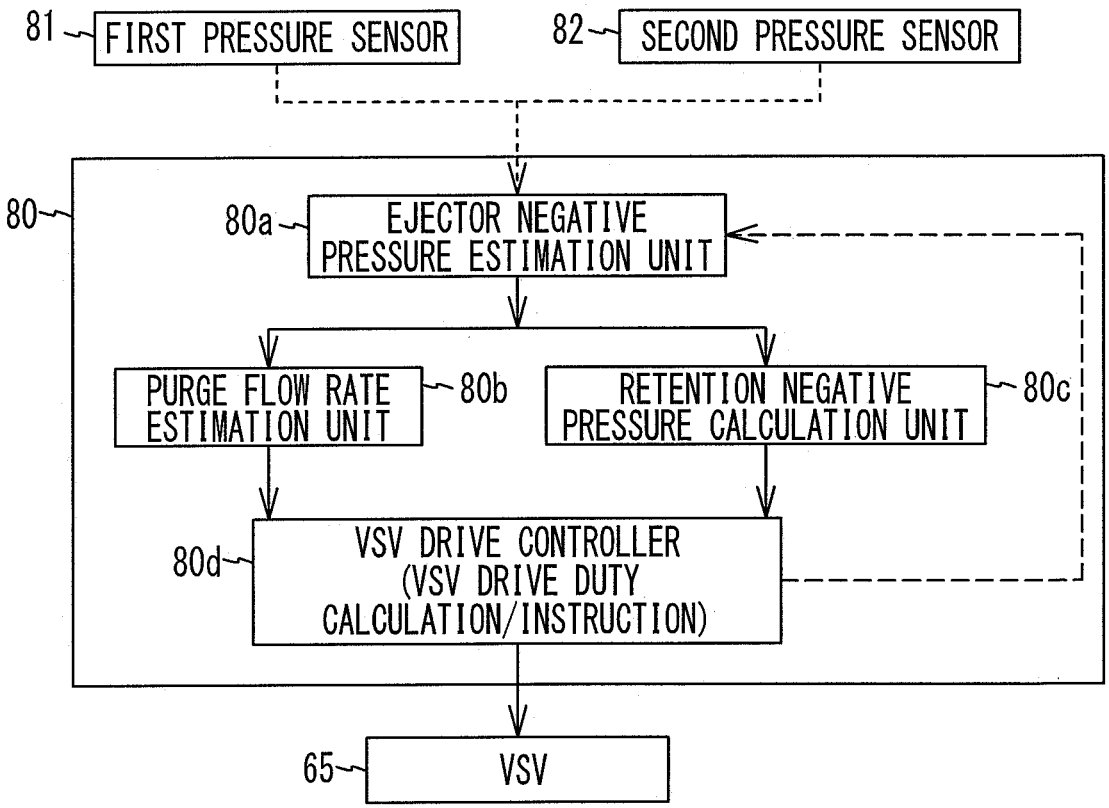
FIG. 2 is a functional block diagram of an ECU.

As illustrated in FIG. 2, the ECU 80 includes an ejector negative pressure estimation unit 80*a*, a purge flow rate estimation unit 80*b*, a retention negative pressure calculation unit 80*c*, and a VSV drive controller 80*d* in functional terms.

The purge flow rate estimation unit 80*b* estimates the flow rate of the purge gas to be delivered to the intake passage 10 through the first branch passage 68 with use of the ejector negative pressure estimated by the ejector negative pressure estimation unit 80*a*. The purge flow rate estimation unit 80*b* also calculates the flow rate of the purge gas delivered to the intake passage 10 through the second branch passage 69. The retention negative pressure calculation unit 80*c* calculates the retention negative pressure when the VSV 65 is in a closed state. The VSV drive controller 80*d* controls drive of the VSV 65 based on the flow rate of the purge gas calculated by the purge flow rate estimation unit 80*b* and the value of the retention negative pressure calculated by the retention negative pressure calculation unit 80*c*.

Described herein is the reason why the ejector negative pressure estimation unit 80*a* estimates the ejector negative pressure based on the opening period (the drive duty) of the VSV 65 and the second pressure. The ejector negative pressure functions as an energy for delivering the purge gas to the intake passage 10 upstream of the compressor 41 through the first branch passage 68 and the ejector 70. The ejector 70 draws the purge gas to the suction port 70*a* from the first branch passage 68 by the negative pressure generated when a part of the intake air is recirculated from the intake passage 10 downstream of the compressor 41 and then discharged from the exhaust port 70*c*. Thus, the ejector negative pressure is affected by the second pressure, which is the pressure downstream of the compressor 41, i.e., the supercharging pressure. The ejector negative pressure is also affected by the pressure state in the first branch passage 68. As the ejector negative pressure varies, the flow rate of the purge gas to be delivered to the intake passage 10 through the ejector 70 varies. That is, the flow rate of the purge gas to be delivered through the ejector 70 increases as the ejector negative pressure increases (the absolute value of the ejector negative pressure increases), and decreases as the ejector negative pressure decreases (the absolute value of the ejector negative pressure decreases).

Figure 3:
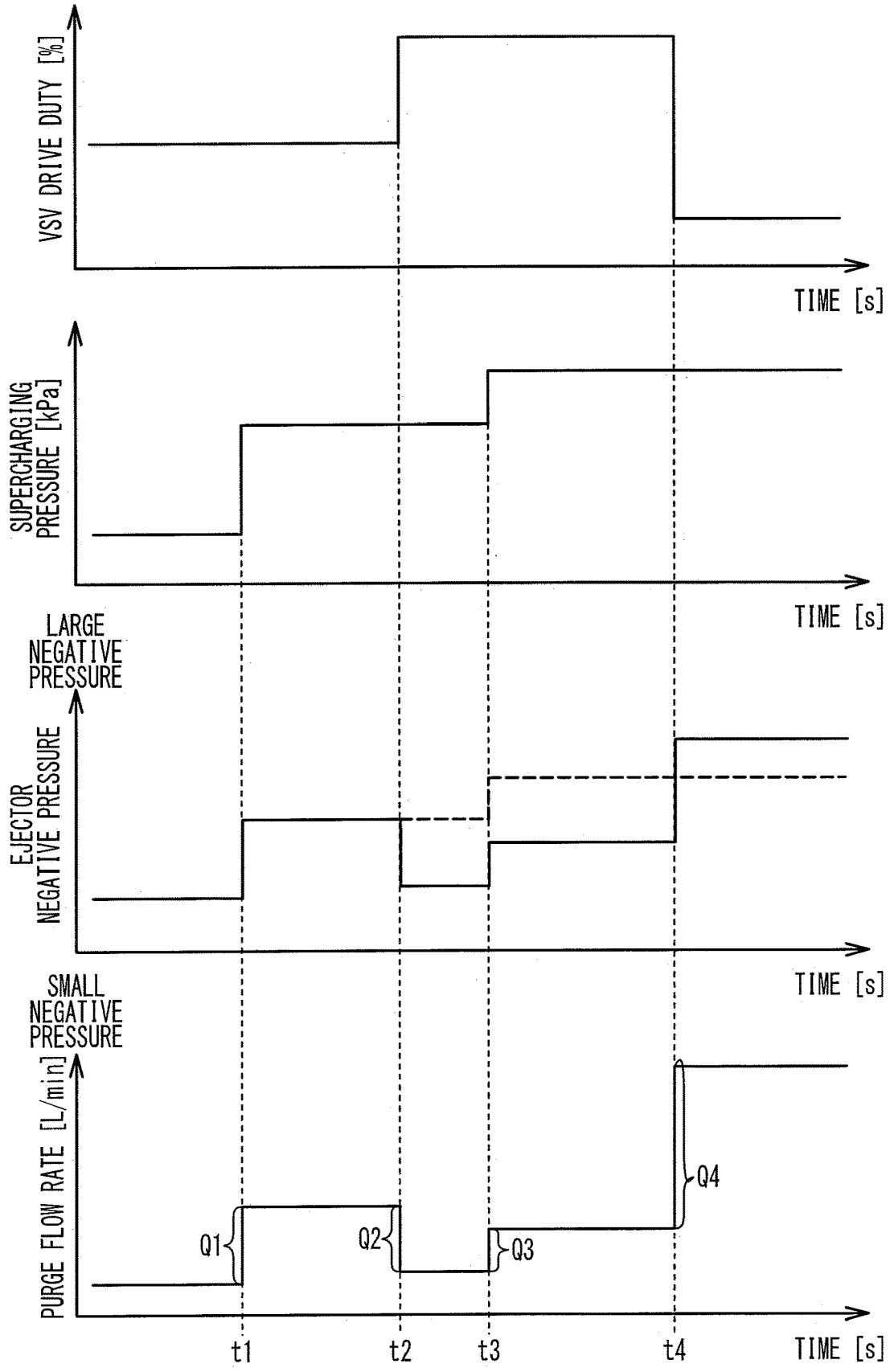
FIG. 3 is a graph illustrating variation in ejector negative pressure and variation in the flow rate of the purge gas delivered through an ejector due to variation in supercharging pressure and variation in VSV drive duty.

FIG. 3 is a graph illustrating variation in the ejector negative pressure and variation in the flow rate of the purge gas to be delivered through the ejector 70 due to variation in supercharging pressure and variation in the VSV drive duty. As illustrated in FIG. 3, when the supercharging pressure rises at time t1, the ejector negative pressure also rises. As a result, the purge flow rate increases. The increased amount Q1 of the purge flow rate is due to the increase in supercharging pressure. Then, when the VSV drive duty increases and the opening period of the VSV 65 therefore becomes longer at time t2, the ejector negative pressure decreases. As a result, the purge flow rate decreases. The decreased amount Q2 of the purge flow rate is due to the decrease in ejector negative pressure.

Figure 4:
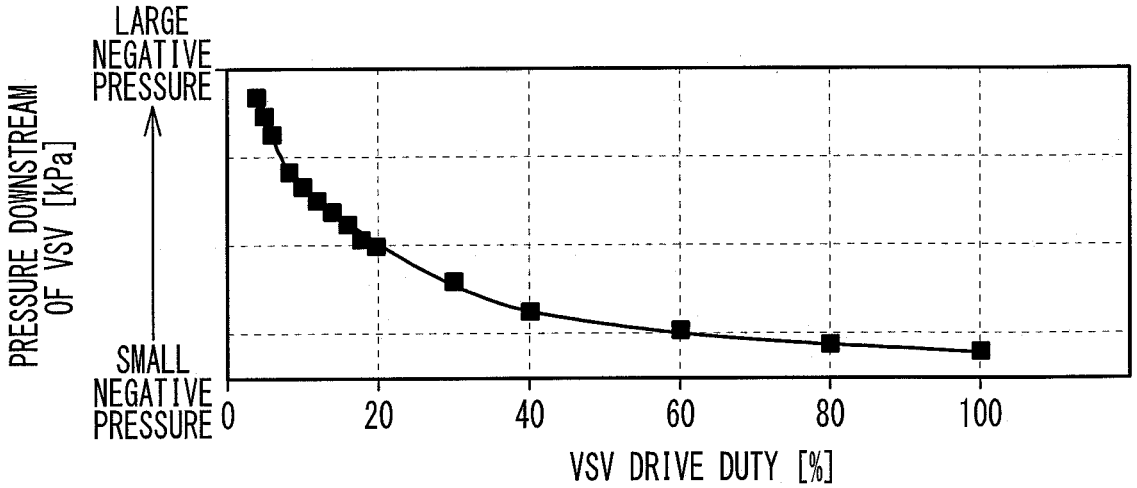
FIG. 4 is a graph illustrating a relationship between the VSV drive duty and a pressure downstream of a VSV.

Here, the relationship between the VSV drive duty and the pressure downstream of the VSV will be described with reference to FIG. 4. FIG. 4 is a graph illustrating the relationship between the VSV drive duty and the pressure downstream of the VSV obtained through experiments. The pressure downstream of the VSV is a pressure in a region that is located immediately after the VSV 65, i.e., located downstream of the VSV 65, and is surrounded by the first check valve 68*a* and the second check valve 69*a*. The experiment results reveal that as the VSV drive duty increases, in other words, as the opening period of the VSV becomes longer, the pressure downstream of the VSV becomes smaller negative pressure. The ejector 70 is coupled to the branching point 67*a*, located downstream of the VSV 65, through the first branch passage 68. Thus, the ejector negative pressure is affected by the VSV drive duty. The acquisition of the relationship between the VSV drive duty and the pressure downstream of the VSV described above in advance allows the pressure downstream of the VSV and therefore the ejector negative pressure to be estimated without directly detecting the value of the pressure downstream of the VSV. Therefore, the ejector negative pressure can be estimated based on the value of the VSV drive duty that is held by the ECU 80 without newly providing a pressure sensor for measuring the pressure downstream of the VSV.

Referring back to FIG. 3, when the supercharging pressure rises at time t3, the ejector negative pressure rises. As a result, the purge flow rate increases. The increased amount Q3 of the purge flow rate is due to the increase in ejector negative pressure. When the VSV drive duty decreases at time t4 and the opening period of the VSV 65 therefore becomes shorter, the ejector negative pressure increases. As a result, the purge flow rate increases. The increased amount Q4 of the purge flow rate is due to the increase in ejector negative pressure.

The following describes estimation of the ejector negative pressure, calculation of the retention negative pressure, and the drive control of the VSV 65 in the above internal-combustion engine system 100 with reference to FIG. 5 through FIG. 10.

Figure 5:
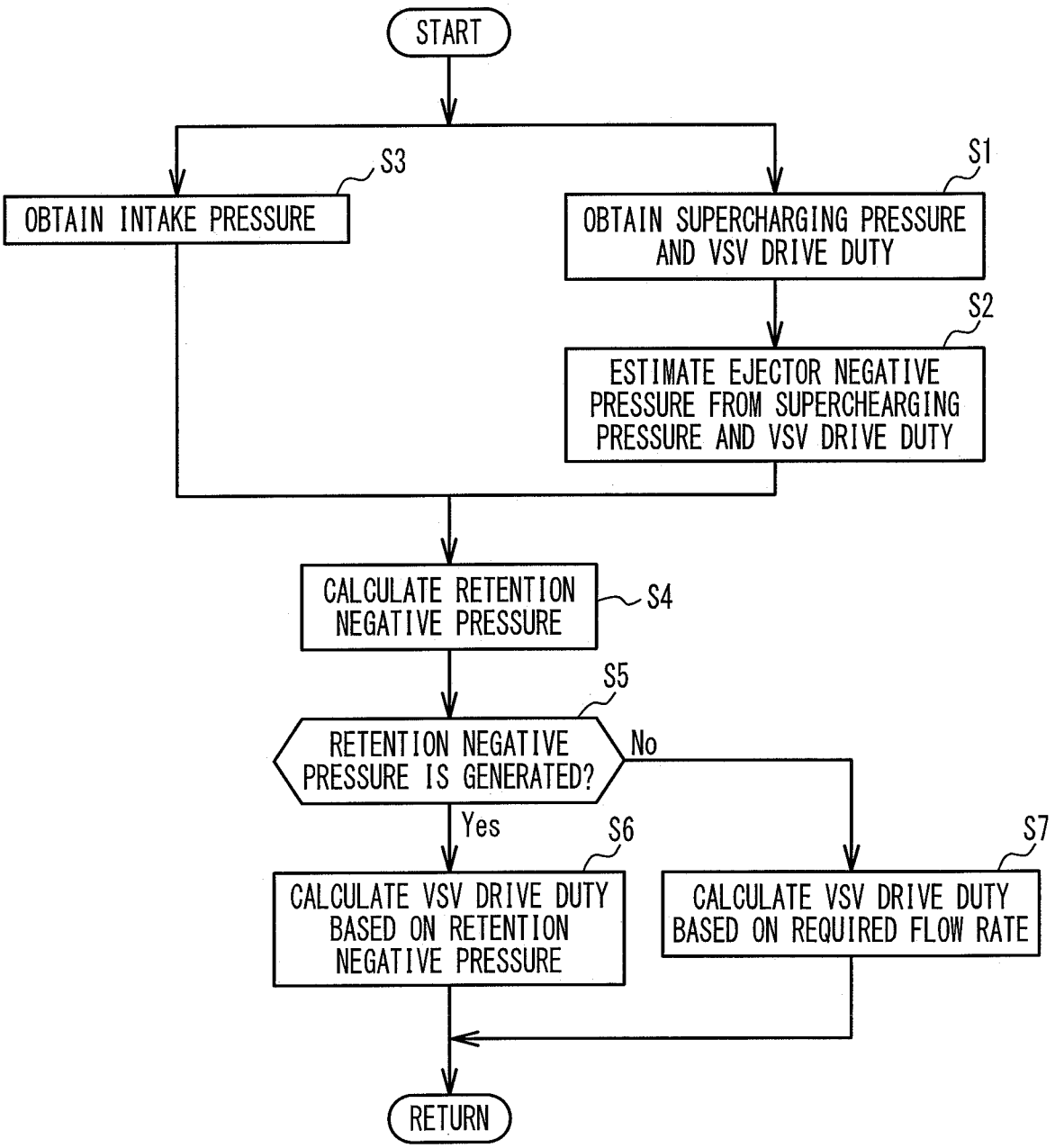
FIG. 5 is a flowchart of an exemplary control by the control device for an internal-combustion engine of the embodiment.

The ECU 80 controls the purge system 60. In particular, the ECU 80 controls the drive of the VSV 65. As illustrated in FIG. 5, the ECU 80 executes the processes from step S1 to step S7, repeatedly. The ECU 80 executes the processes from step S1 to step S7 as the drive control of the VSV 65 at intervals of predetermined repetition time T. In the flowchart illustrated in FIG. 5, the processes from step S1 to step S2 are processes for obtaining the retention negative pressure in the first branch passage 68 coupled to the intake passage 10 upstream of the compressor 41. On the other hand, the process of step S3 is a process for obtaining the retention negative pressure in the second branch passage 69 coupled to the intake passage 10 downstream of the compressor 41. The processes from step S1 to step S2 and the process of step S3 are executed in parallel. Then, in step S4 and subsequent steps, the instruction to drive the VSV 65 is issued by using the results obtained through the processes from step S1 to step S2 and the results obtained through the process of step S3.

Figure 6:
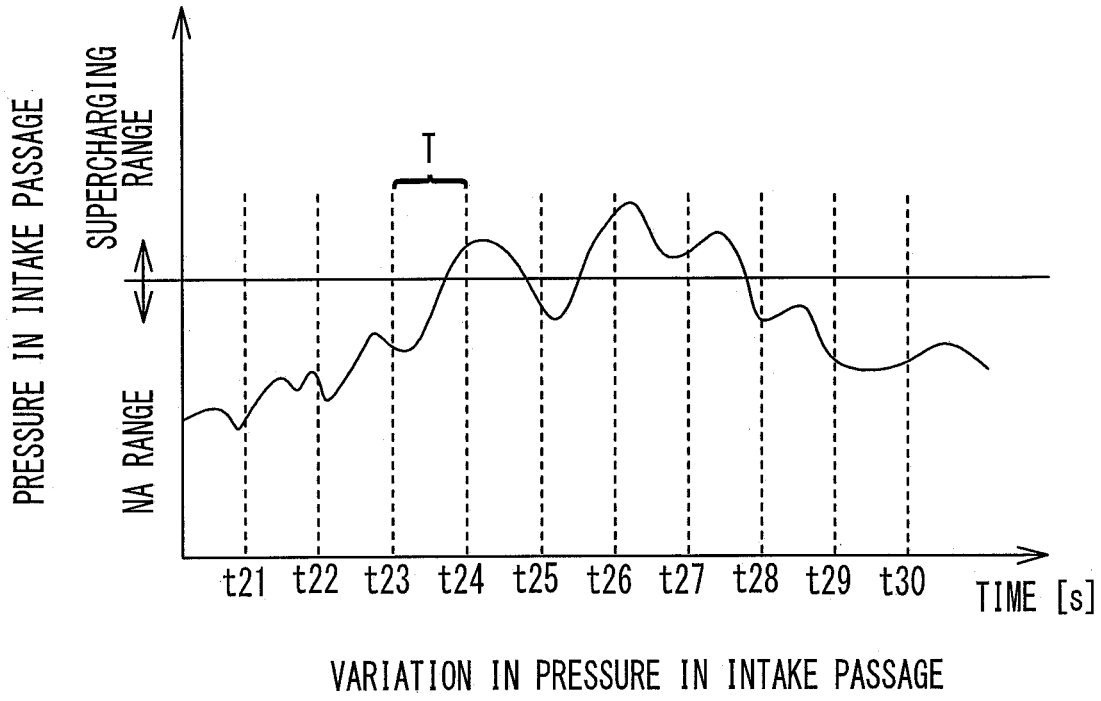
FIG. 6 is a graph illustrating variation in pressure in an intake passage.
Figure 8:
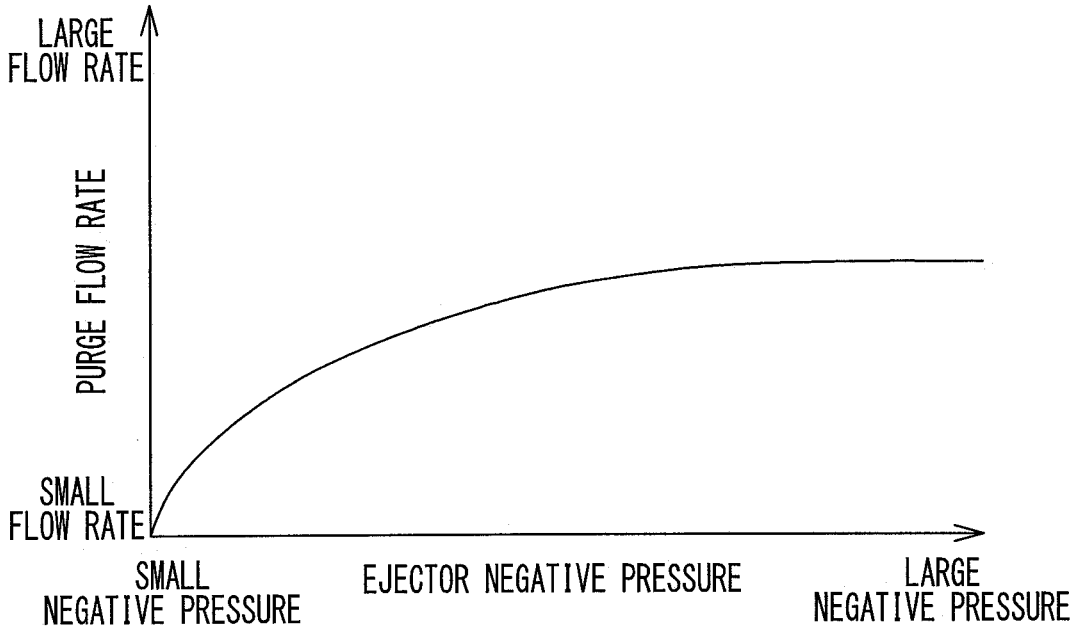
FIG. 8 illustrates a map for obtaining the flow rate of the purge gas to be delivered through the ejector in the first branch passage based on the ejector negative pressure.
Figure 9:
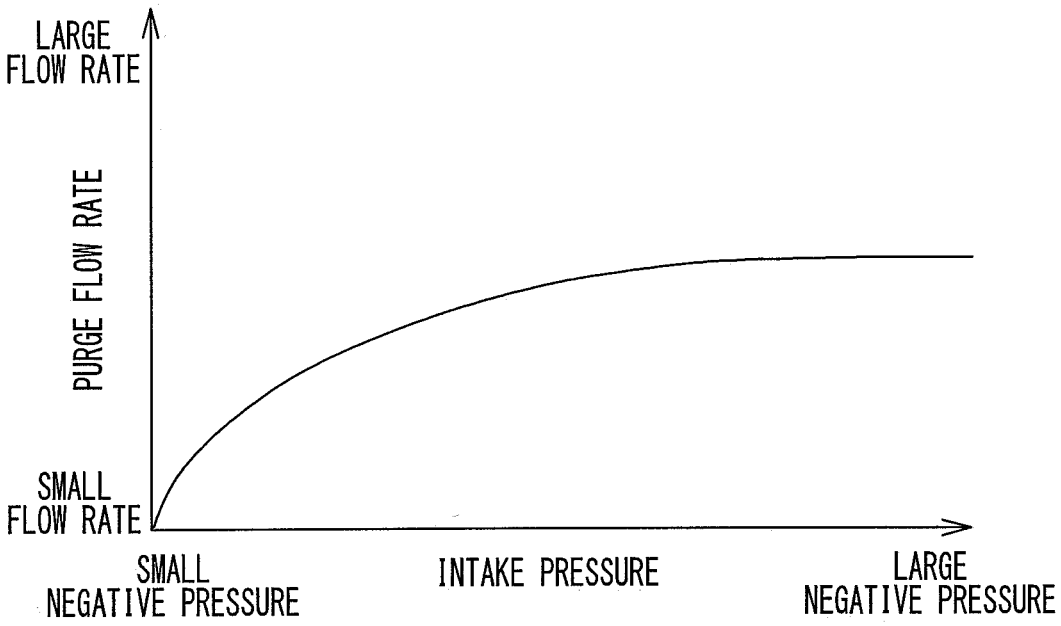
FIG. 9 illustrates a map for obtaining a purge flow rate in a second branch passage based on an intake pressure.

As illustrated in FIG. 6, the pressure in the intake passage 10 varies from moment to moment. The time interval in the horizontal axis, for example, the interval between time t21 and time t22 and the interval between time t22 and time t23 correspond to the repetition time T of the control. For example, from time t22 to time t23, the operation range of the internal-combustion engine system 100 is the NA range. In this case, effective values are not obtained through the processes from step S1 to step S2, and the value obtained through the process of step S3 is used in the processes in step S4 and subsequent steps. On the other hand, for example, from time t26 to time t27, the operation range of the internal-combustion engine system 100 is the supercharging range. In this case, an effective value is not obtained through the process of step S3, and the values obtained through the processes from step S1 to step S2 are used in the processes in step S4 and subsequent steps. From time t25 to time t26, the supercharging range and the NA range are mixed. In this case, both the values obtained through the processes from step S1 to step S2 and the value obtained through the process of step S3 are used in the processes in step S4 and subsequent steps.

The ECU 80 is able to determine whether the operation range of the internal combustion engine system 100 is the supercharging range or the NA range by comparing the detection value by the first pressure sensor 81, which detects the atmospheric pressure, and the detection value by the second pressure sensor 82, which detects the supercharging pressure.

In step S1, the ejector negative pressure estimation unit 80*a* of the ECU 80 obtains the supercharging pressure and the VSV drive duty. The value detected by the second pressure sensor 82 is obtained as the supercharging pressure. The VSV drive duty is calculated from a required flow rate.

In step S2, the ejector negative pressure estimation unit 80*a* estimates the ejector negative pressure from the supercharging pressure and the VSV drive duty. In the present embodiment, the ejector negative pressure is estimated with a map created so as to satisfy adjustment conditions obtained through experiments in advance. As illustrated in FIG. 7, for example, when the supercharging pressure is Ps1 [kPa] and the VSV drive duty is D1 [%], the ejector negative pressure is Pel1 [kPa]. As described above, use of the map allows the ejector negative pressure according to the combination of the supercharging pressure and the VSV drive duty to be estimated. The ejector negative pressure may be estimated with use of an arithmetic equation based on Bernoulli's theorem.

Next, step S3 will be described. In step S3, the intake pressure is obtained. The pressure detected by the third pressure sensor 83 is obtained as the intake pressure.

In step S4, the retention negative pressure calculation unit 80*c* calculates the retention negative pressure from the ejector negative pressure or the intake pressure. Basically, the retention negative pressure is determined based on the calculation result of which the negative pressure is larger.

In step S5, the VSV drive controller 80*d* determines whether the retention negative pressure is generated based on the calculation results in step S4. When the determination is Yes in step S5, the VSV drive duty is determined based on the retention negative pressure in step S6. When it is determined that the retention negative pressure is generated based on the calculation results in step S4, the VSV drive duty is determined based on the retention negative pressure that has led to the determination. On the other hand, when it is determined that the retention negative pressure is generated based on both the calculation results in step S4, the VSV drive duty is determined based on the calculation result of which the retention negative pressure is larger. The VSV drive duty is set according to the adjustment of the actual machine in advance, and is set so as to become larger as the value of the retention negative pressure becomes larger.

When the determination in step S5 is No, the VSV drive controller 80*d* determines the VSV drive duty based on a required flow rate in step S7. The VSV drive duty is set according to the adjustment of the actual machine in advance, and is set so as to become larger as the total flow rate of the purge gas becomes larger.

Figure 10:
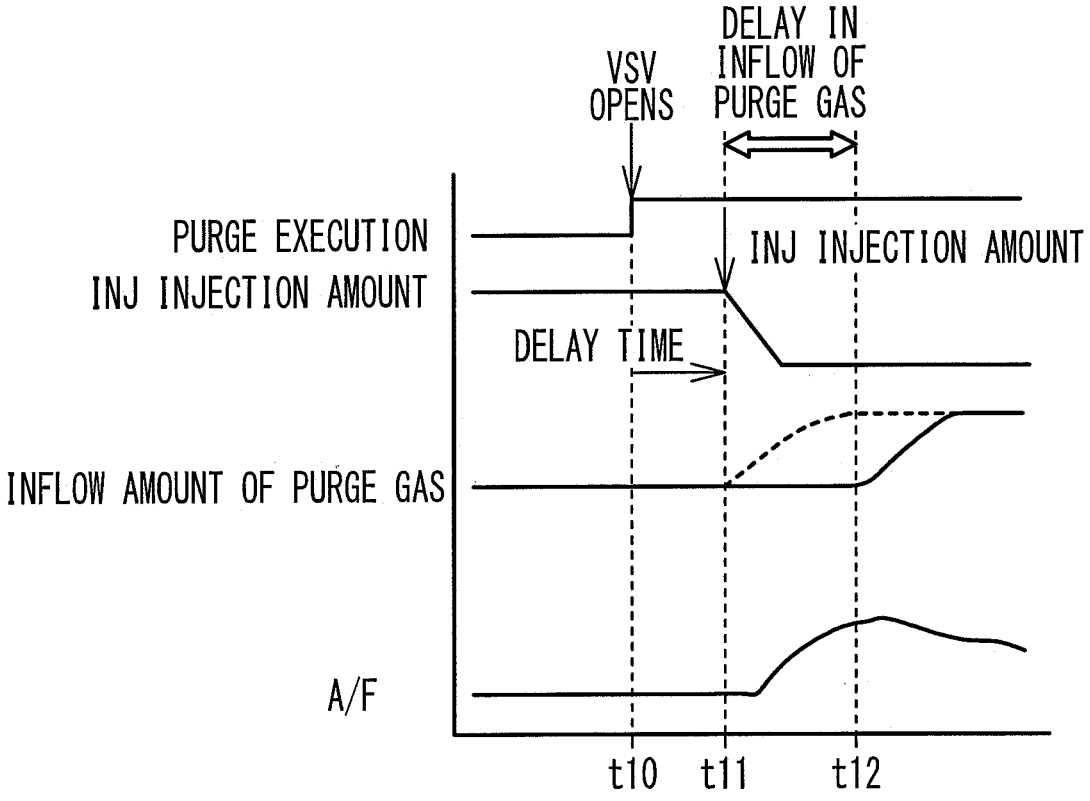
FIG. 10 is a graph illustrating delay in the inflow of the purge gas.

Here, with reference to the graph illustrated in FIG. 10, the effect of the retention negative pressure on the opening operation of the VSV 65 will be described. As illustrated in FIG. 10, at time t10, the VSV 65 is instructed to open, and the purge is conducted. In addition, fuel is injected from the fuel injection valve 23. The amount of the fuel injected from the fuel injection valve 23 is reduced by the amount of the purge gas in consideration of the purge flow rate. In the example illustrated in FIG. 10, the period from time t10 to time t11 is set as a delay time. Then, the amount of the fuel to be injected from the fuel injection valve 23 is reduced according to the flow rate of the purge gas of which inflow starts from time t11 under the assumption that inflow of the purge gas starts from time t11.

However, it may be, for example, at time t12 that inflow of the purge gas is actually started. Delay in inflow of the purge gas leads to shortage of the fuel in the engine by the amount of the purge gas of which inflow is delayed, and also causes variation in A/F ratio.

One of the reasons why the inflow of the purge gas is delayed as described above is considered because the VSV 65 becomes difficult to open because of the effect of the retention negative pressure. That is, the VSV 65 becomes more difficult to open as the retention negative pressure increases (the absolute value of the retention negative pressure increases), and the timing at which the VSV 65 actually opens is delayed after the instruction to open the valve is issued. Thus, the VSV drive controller 80*d* determines the VSV drive duty, in step S6, such that the VSV 65 opens at a desired timing even when the VSV 65 is being affected by the retention negative pressure.

The VSV drive duty calculated in the above described manner is output as the drive instruction for the VSV 65 for the period of next repetition time T.

In the present embodiment, when purge gas is delivered to the intake passage 10 through the ejector 70, the state of the pressure between the VSV 65 and the ejector 70, i.e., the ejector negative pressure is precisely estimated and perceived. As described above, the ejector negative pressure is precisely estimated, and therefore the purge flow rate is precisely estimated. Furthermore, the control accuracy of the A/F is improved by setting the VSV drive duty in consideration of the retention negative pressure.

Although some embodiments of the present disclosure have been described in detail, the present disclosure is not limited to the specific embodiments but may be varied or changed within the scope of the present disclosure as claimed.

What is claimed is:

1. A control device for an internal-combustion engine, comprising:

a canister configured for recovering fuel evaporated in a fuel tank;

a purge valve configured to control a flow rate of purge gas flowing out from the canister;

a turbocharger including a compressor disposed in an intake passage;

a purge passage connecting the canister and the intake passage and branching into a first branch passage and a second branch passage, the first branch passage being coupled to the intake passage upstream of the compressor, the second branch passage being coupled to the intake passage downstream of the compressor;

an ejector including an exhaust port, an intake port, and a suction port, the exhaust port being coupled to the intake passage upstream of the compressor;

a recirculation passage being coupled to the intake port, the recirculation passage being configured for recirculating intake air from the intake passage downstream of the compressor to the intake passage upstream of the compressor;

the first branch passage being coupled to the suction port;

a first pressure acquirer configured to obtain a first pressure that is a pressure upstream of the compressor in the intake passage;

a second pressure acquirer configured to obtain a second pressure that is a pressure downstream of the compressor in the intake passage; and an ejector negative pressure estimator configured to estimate an ejector negative pressure based on an opening period of the purge valve and the second pressure, the ejector negative pressure being a pressure at which the ejector draws the purge gas from the first branch passage through the suction port to the intake passage upstream of the compressor.

2. The control device according to claim 1, wherein the ejector negative pressure estimator is configured to estimate an absolute value of the ejector negative pressure to be smaller as the opening period of the purge valve is longer, and is configured to estimate an absolute value of the ejector negative pressure to be smaller as the second pressure is smaller.

3. The control device according to claim 1, wherein each of the first branch passage and the second branch passage includes a check valve that inhibits flowback of the intake air from the intake passage toward the purge valve, and the control device further comprises a retention negative pressure calculator configured to calculate a retention negative pressure based on the ejector negative pressure and the first pressure, the retention negative pressure being a negative pressure between the check valves and the purge valve when the purge valve is in a closed state.

4. The control device according to claim 1, wherein the purge valve is a duty control valve, and the opening period of the purge valve is controlled according to a drive duty.

5. The control device according to claim 1, further comprising:

a purge flow rate estimator configured to estimate a flow rate of purge gas to be delivered to the intake passage through the first branch passage based on the ejector negative pressure.

6. The control device according to claim 3, wherein the opening period of the purge valve is based on a flow rate of the purge gas requested to be delivered to the intake passage and the retention negative pressure.

7. The control device according to claim 3, wherein the opening period of the purge valve is based on a flow rate of the purge gas requested to be delivered to the intake passage and corrected by an amount of time that is based on the retention negative pressure.

* * * * *